US007506721B2

(12) United States Patent
Moore

(10) Patent No.: US 7,506,721 B2
(45) Date of Patent: Mar. 24, 2009

(54) CONVERTIBLE FOLDED HORN ENCLOSURE

(76) Inventor: Dana A. Moore, 25-157 th Pl. SE., Bothell, WA (US) 98012

( * ) Notice: Subject to any disclaimer, the term of this patent is extended or adjusted under 35 U.S.C. 154(b) by 189 days.

(21) Appl. No.: 11/595,204

(22) Filed: Nov. 10, 2006

(65) Prior Publication Data

US 2008/0110692 A1 May 15, 2008

(51) Int. Cl.
*H04R 1/02* (2006.01)
*G10K 11/28* (2006.01)

(52) U.S. Cl. ..... 181/156; 181/148; 181/152; 181/177; 181/199; 381/337; 381/338; 381/339; 381/340; 381/341; 381/345; 381/352

(58) Field of Classification Search ..... 181/199, 181/156, 177, 152, 148; 381/345, 337, 338, 381/339, 340, 341, 352
See application file for complete search history.

(56) References Cited

U.S. PATENT DOCUMENTS 2,815,086 A 12/1957 Hartsfield
2,858,899 A * 11/1958 Lopez-Henriquez ..... 181/155
3,108,653 A * 10/1963 Valldeperas ..... 181/150
3,912,866 A * 10/1975 Fox ..... 381/352
4,210,223 A * 7/1980 Gillum et al. ..... 181/152
4,860,367 A * 8/1989 Hook ..... 381/341
5,189,706 A * 2/1993 Saeki ..... 381/349
5,266,752 A * 11/1993 Cussans ..... 181/155
5,359,158 A * 10/1994 Queen ..... 181/150
5,637,840 A * 6/1997 Kim ..... 181/152
5,804,774 A * 9/1998 Ford et al. ..... 181/152
6,144,751 A * 11/2000 Velandia ..... 381/345
6,530,451 B2 * 3/2003 Noselli ..... 181/179
6,744,902 B2 * 6/2004 Proni ..... 381/386
7,233,677 B2 6/2007 Moore
2005/0217927 A1 * 10/2005 Noselli et al. ..... 181/191
2005/0276431 A1 * 12/2005 Moore ..... 381/340

* cited by examiner

*Primary Examiner*—Walter Benson
*Assistant Examiner*—Jeremy Luks

(57) ABSTRACT

A low frequency exponential bass horn enclosure employing a large area unitary throat pathway, bifurcated at a substantially parabolic rearward channel wall, convertible to a front-loaded or rear-loaded configuration by the use of interchangeable parts, with driver access from the front. Intended for corner placement, however, fully enclosed horn channel allows for floor use. The axially-centered throat expands vertically, exhausts rearward, and is bifurcated at the back of the enclosure with two hard reflection points, comprising a single fold, in which the vertically arranged horn terminus exhausts with a forward-canted splay angle around a partially rectangular back chamber.

13 Claims, 4 Drawing Sheets

CONVERTIBLE FOLDED HORN ENCLOSURE

BACKGROUND OF THE INVENTION

The present invention relates to loudspeaker enclosures of the low frequency exponential folded horn type primarily intended for corner placement, however is capable of free-standing use as needed. In particular, the present invention features a relatively large-area unitary throat pathway which is bifurcated horizontally at the rear of the enclosure, and exhausts in a relatively forward direction.

The Klipsch and Delgado AES paper, "A Revised Low-Frequency Horn of Small Dimensions", Vol. 48, No. 10, October 2000, describes a dual 12-inch driver folded horn enclosure featuring throat bifurcation of the horn channels which are horizontally folded. A defining feature of the device is the forward-canted terminal channels exiting on each side of a central planar baffle. The use of forward-canted exit splay angles is explained as providing an increase in upper band pass frequency response by more direct wave propagation to the audience. Due to the throat bifurcation, the access opening to the drivers is required to be on both the top and bottom of the enclosure. The device is configured specifically for a particular driver with explicit parameters.

Another prior art example is my previous U.S. Patent Application Pub. No. 2005/0276431 titled "Top-Loading Folded Corner Horn" which also features a bifurcated-throat horn pathway which folds exclusively in the horizontal plane, however, it does not incorporate forward-canted exit channels, instead, it exits along the side walls of the corner. The indirect exit channel splay-angles do provide a physical limitation to the upper frequency limit in which it can propagate without apparent distortion. In order to achieve an even higher crossover point as compared to my previous invention where the limit appears to be 600 Hz, the use of forward-angled exit channels to allow a more direct path to the listening position is seemingly required. The inclusion of forward-canted exit channels bears with it the added complication and weight of including external side walls to fully enclose the horn pathway. Several factors also enter into the contemplating the benefits of such an addition would make to the single 15-inch driver device. For instance, the built-in outer side walls would free the enclosure from requiring external planar boundaries to be in close proximity. This allows for a more generalized placement for the enclosure, while still allowing for ⅛th space placement for achieving the maximum low frequency response, however, it also would greatly increase the overall weight and the-complexity of construction, for relatively little increase in utility.

The increased capabilities presented by the use of dual drivers also provides useful benefits, such as providing wiring options which effect efficiency and power handling capabilities, overall sound pressure levels, and a naturally shorter horn path length for a given low frequency cutoff (Fc) due to a larger effective throat size. It is well known in the art that horn pathway lengths below a certain division of wavelength will suffer from variances in reactance and subsequently produce peaks in the response unless the reactance is properly annulled. The horn path length is dependent on the mouth size, throat size and the chosen flare rate. The U.S. Pat. No. 4,210,233 to Gillum et al., teaches the minimum mouth size [area] for corner placement can be as small as 1/12 wavelength [in diameter] if the driver is properly annulled. It can be assumed that the horn path length is also, as a matter of course, shortened if the throat size and flare rate remains unchanged. Conversely, horns with large throat areas, proper mouth sizes, and having short pathway lengths require reactance annulling due to the short pathway lengths involved in order to maintain a relatively flat response over the operating band pass.

A particular drawback of using dual 15-inch diameter drivers is that the overall footprint of the device must be increased to accommodate a relatively large (78 square inch) throat area per driver especially if bifurcated at the throat. The use of smaller throat cross-section channels would tend to limit the maximum sound pressure level due to air overload distortion, and possibly require the use of smaller diameter drivers to compensate. This problem is typically overcome by employing a rapid flare rate at the throat to modify the effects of excessive reactance that a more confined flare rate (of lower Fc) of a relatively small channel cross-section would embody.

The ability to achieve lower distortion, in a general sense, is that large throat cross-sections can allow for higher air velocity transit compared to a more restricted channel, and therefore throat overload distortion limits are relegated to the more extreme end of the performance curve.

Another consideration that particularly effects front-loaded horns in general is thermal voice coil overload or failure in sustained high sound pressure level (SPL) use. This aspect is compounded in the case of dual-drivers in a sealed back chamber, and may be exacerbated by the tendency of modern high wattage drivers requiring smaller back chamber air volumes than in the past for reactance annulling purposes. It seems advisable that, in the case of high wattage drivers in a infinite baffle configuration and used for prolonged periods at a high sound pressure level (SPL), should be provided an adequate means of cooling the voice coils, such as conducting the generated heat to a heat-sink assembly located preferably outside the back chamber. This object, while technically achievable in the case of a bifurcated-throat design such as the previously cited prior art designs, may not be economically practical due to the complications imposed by the position of the driver(s).

Considerations of footprint size are probably most important in domestic use, however, overall footprint size can also be seen to be inextricably related to enclosure weight, a definite factor in public address use where portability is perhaps the major concern. Enclosures with the best balance of size, weight and performance capability would seem to be the most desirable, regardless of the application. In public-address (PA) including live music applications where higher SPL's are generally desirable, the use of additional bracing for preventing internal enclosure wall vibration adds weight to the enclosure, and effects portability. The tradeoff for domestic situations seems to be that low frequencies with relatively high efficiencies typically means a larger enclosure, with the attendant larger footprint, and the tradeoff for PA use is that achieving high SPL's typically means heavier (or multiple) enclosures are required.

For PA applications, it is reasonable to assume that multiple smaller-volume cabinets (for stacking) allow for easier porting and packing for transportation purposes than a comparable single, larger-volume cabinet would. However, it seems reasonable for domestic situations, where semi-permanent placement is assumed, and perhaps appearance is an important consideration, that a single large-volume cabinet would be more desirable.

Home Theater (HT) market considerations conceivably fall somewhere in between the typical domestic use, such as a living room, and a PA application. It is typically a much smaller venue than a PA application, but shares some of the same issues, such as overall clarity, maximum SPL, and the presentation of the human voice. The HT market may include less concern for appearance than would the typical domestic situation, for instance, black finishes seem to be preferred as movies tend to be viewed in darkened spaces. Overall footprint size may also be less of a concern when a dedicated HT space is involved. The dynamic soundtracks typical of digital media may require prolonged periods of intense SPL's than common in domestic use, such as listening to high-fidelity (HI-FI) music exclusively. In particular, it can be assumed that the requirements of reproducing highly dynamic sound effects impose somewhat different demands on loudspeaker systems than does music alone.

A loudspeaker enclosure capable of reproducing the low frequency dynamic range available with current digital technology, at relatively high sound pressure levels, if needed, with low distortion, employing a relatively small footprint, and which allows for public address, home theatre, use as musical instrument speakers, and domestic high fidelity use would be highly desirable.

SUMMARY OF THE INVENTION

It is an object of the present invention, in one embodiment, to provide a horn enclosure which allows for conversion to or from front-loaded or rear-loaded operation without modification through the use of interchangeable parts. It is a further object to provide an increase in power handling and sustained high output capability along with an optional facility for-cooling the voice coil for use in high output applications. It is a further object of the current invention to utilize a footprint comparable to the prior art examples cited previously. Another object is to preserve waveform phase integrity as much as possible by reducing the number and severity of folds in the horn pathway as compared to the previously cited bifurcated prior art examples. A still further object is to allow for the ability to use a variety of available drivers to meet specific performance requirements as desired. It is another object of the preferred embodiment to vary the internal back chamber volume via baffle cutouts and plugs to add or subtract specific volumes of void area space to or from the back chamber volume, allowing for the ability to adjust the back chamber volume (Vb) to a general value as needed within the limits of the cavities involved. Further objects and advantages will become apparent in the remainder of the present disclosure.

The current invention departs from the previously cited prior art examples in that it maintains a unitary throat pathway of relatively large cross-section area, suitable for using 15-inch diameter drivers in a symmetrical dual configuration. The unitary horn pathway is bifurcated at the rear of the enclosure and follows a substantially exponential flare to the exit channels, which are canted slightly inward to provide a more direct path to the audience, allowing for extended upper bass frequency propagation. The throat channel is arranged with a horizontal axis and exhausts rearward, dividing the enclosure vertically along the central axis, with access to the back chamber being from the front of the enclosure.

The present invention has the design goal of a low frequency cutoff (Fc) of 38 Hz. The horn terminal exit size is approximately 800 square inches in area, which is appropriate for ⅛th space (corner placement). For ½ space (floor) placement, such as in PA use, the overall low frequency response would be comparatively degraded, as is typical of foreshortened horns, however the overall quality of the response would still be more than adequate for reproducing vocals where the extreme low frequencies are not usually present.

The disclosed invention has a footprint that uses approximately 26½ inches from the rear of the enclosure to the outside edge of the front panel and an overall width of approximately 39¾ inches. The overall height of the invention is approximately 39 inches. The overall size and footprint of the invention is consistent with the sizes of the prior art examples previously referenced.

The preferred front-loaded embodiment uses full-channel hard surface reflectors to aid in maintaining phase relationships of the given waveform. It is intended to provide the least tortuous horn pathway possible for the waveform to travel within the limitations imposed by footprint size constraints, and to that end, incorporates a single fold comprised of two controlled reflection surfaces.

The current invention incorporates fully enclosed horn channels which allows its placement away from walls when desired, however, the low frequency response would be optimized when placed in a corner.

The present invention is intended to maximize versatility for high-sensitivity domestic HI-FI, HT, and PA applications where high output is desired in a relatively small enclosure.

DESCRIPTION OF THE INVENTION

The current invention consists of a folded exponential-horn enclosure which is symmetrical in both horizontal and vertical planes which is contained within a substantially parabola-shaped outer shell as formed by the rear-channel walls. The overall mouth size for an ⅛ space horn (as measured at the terminal exit) required for the given Fc of 38 Hz is approximately 800 square inches in area (where further waveform expansion presumably takes place outside of the enclosure, as is typical), and therefore, the invention in its optimal state is approximately 39 inches in height, which is also determined to present the optimum height for the effective propagation of a top-mounted midrange and/or high frequency horns to a seated audience.

The preferred embodiment of the invention can be seen in FIGS. 2, 3, 9 and 10. The preferred embodiment of the invention embodies two 15-inch drivers needed to achieve the appropriate channel size at the rear of the enclosure. The invention, being symmetrical, is capable of being constructed as single full-height unit or being equally divided in the horizontal plane forming separate half-height enclosures each employing a single 15-inch driver 10, intended to be stacked when in operation, and thereby achieving the optimum overall mouth size. In the present disclosure, the dual-driver single unit version is referred to as the preferred embodiment, and the half-height versions as the alternative embodiments.

Figure 5:
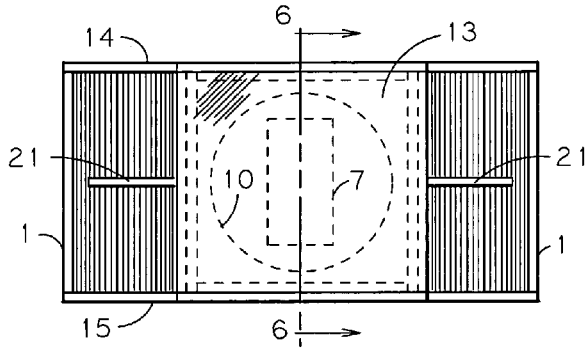
FIG. 5 is a front elevation view of the half-height alternative front-loaded embodiment.
Figure 6:
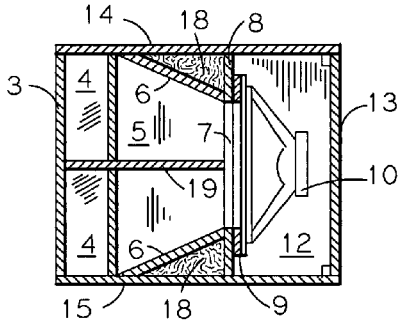
FIG. 6 is a sectional view from line 6-6 of FIG. 5 of the half-height alternative front-loaded embodiment.
Figure 8:
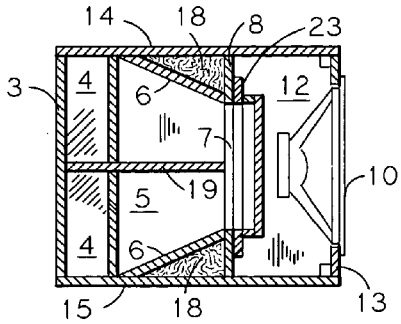
FIG. 8 is a sectional view from line 8-8 of FIG. 7 of the half-height alternative rear-loaded embodiment.
Figure 9:
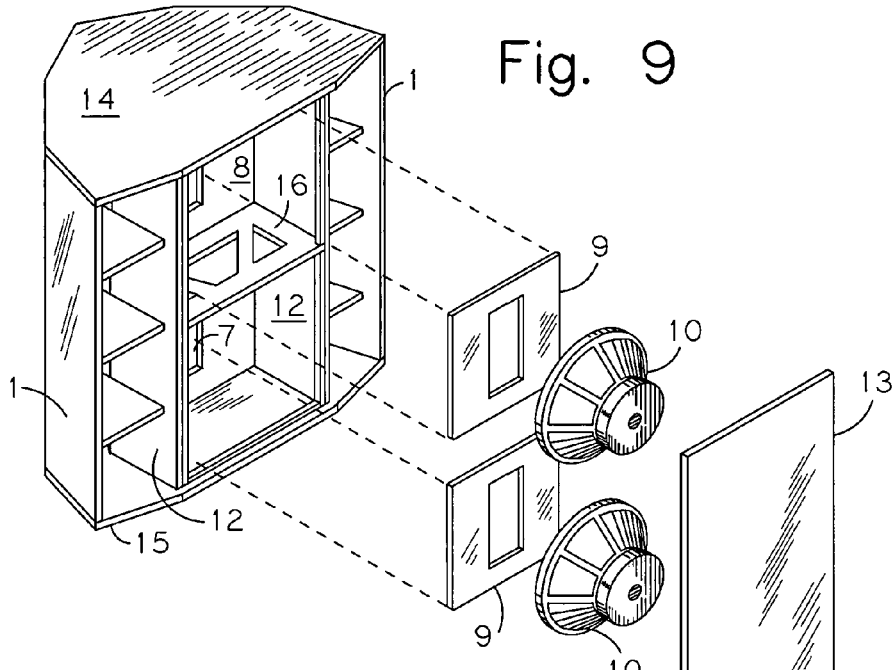
FIG. 9 is a exploded view of the preferred front-loaded embodiment.

The half-height embodiments seen in FIGS. 5 though 8 are considered a desirable modification of the current invention specifically for use in PA-type applications for reasons of easier portability. The full-height embodiment is considered desirable in the case of domestic use where appearance is presumably more important. In the present disclosure, it can be assumed that the same elements in both the full and half-height embodiments are functionally equivalent when present in the half-height embodiments. Referring to FIGS. 6 and 8, this is most apparent in viewing the half-height embodiments shown in cross-section.

The overall throat cross-sectional area was selected as a best match for the reduced footprint size requirement, reduced throat distortion, and the desired low frequency response. The current invention is disclosed in the drawings as being constructed of ¾ inch thick panels.

Figure 1:
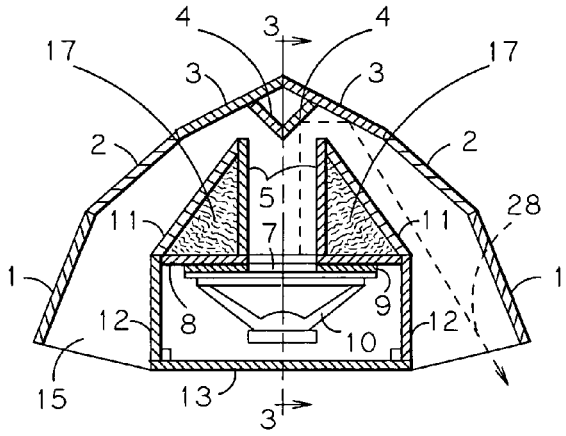
FIG. 1 is a sectional view from line 1-1 of FIG. 2 of the preferred front-loaded embodiment of the invention with the horizontal bracing elements not shown.
Figure 3:
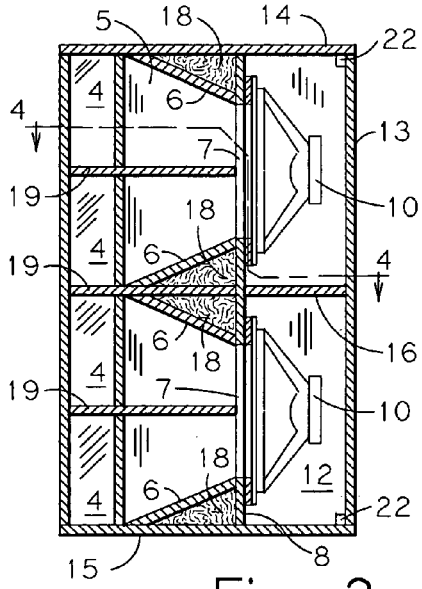
FIG. 3 is a sectional view from lines 3-3 of FIGS. 1 and 2 of the preferred front-loaded embodiment.

Exponential expansion rates are used exclusively. The initial throat expansion rate is 50 Hz or an exponential area doubling length of 16 inches, and the terminal exit channel is 38 Hz or an area doubling length of 19.6 inches. The throat horn pathway is best seen in FIGS. 1 and 3. The preferred embodiment throat cavity opening 7 area is approximately 78 square inches per 15-inch diameter driver 10, which presents an equal match to the respective throat area. The preferred embodiment throat cross-sectional area is 13 by 6 inches.

Figure 2:
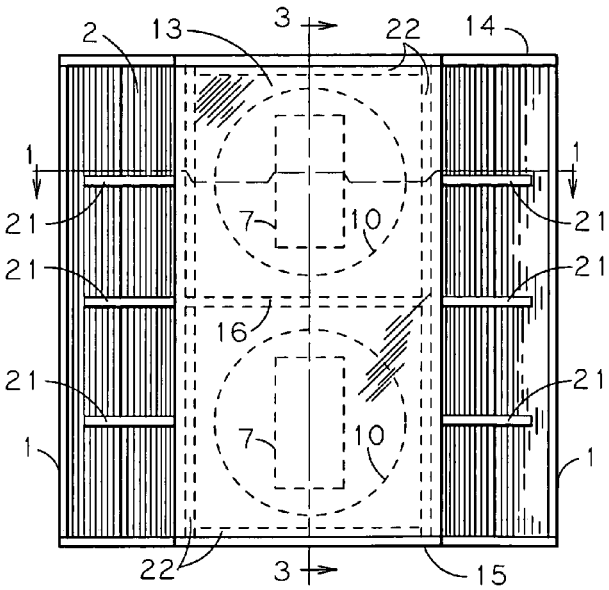
FIG. 2 is a front elevation view of the preferred front-loaded embodiment.

Referring to FIG. 1, the preferred embodiment of the invention is shown in cross-section as derived from line 1-1 of FIG. 2. The view of FIG. 1 does not include the horizontal braces 16, 19, 20, 21 for clarity. The horizontal braces 16, 19, 20, 21 are shown separately in FIG. 4, which is derived from line 4-4 of FIG. 3.

The 15-inch driver embodiments allow for the inclusion or exclusion of the void spaces to be added or subtracted from the available back chamber volume (Vb). The void spaces are divided into two groups, the large vertical areas associated with the sides of the throat channels 17, and the smaller void areas 18 associated with the vertical expansion of the throat channels. Without treating the rectangular back chamber area, the maximum treated volume of the combination of back chamber and all void spaces is 3.2 cubic feet per driver, and the minimum of the back chamber proper and the smaller void spaces is 1.8 cubic feet per driver. These values provide a range which most drivers capable horn loading inside of the available throat area can be effectively annulled in at the overall Fc of the horn. In this disclosure, treating refers to the practice of filling the void spaces with a fibrous absorptive material (such as fiberglass) which allows for up to a 25% increase in effective volume to be achieved. In the drawing figures, when present, the void cavities 17, 18 are shown completely filled with a fibrous sound absorptive material representing the maximum volume of available void space.

In the current disclosure, a specific range of suitable drivers with appropriate Thiele/Small parameters for horn loaded operation within the stated minimum and maximum volumes have been selected, and the two groups of void space volumes forming "steps" in available Vb, and two corresponding groups of suitable drivers to be used, the large throat/large Vb drivers, and the small throat/small Vb drivers. The invention is capable of accommodating either group of drivers with regard to the void spaces included or excluded from the Vb, and the treating thereof. In most cases of the large throat/large Vb drivers, at least a minimal treatment of the back chamber proper is necessary, such as a single layer of material along the bottom. The void areas 17, 18 are optionally connected to the back chamber via baffle 8 cutouts as is typical in the art.

The wide selection of drivers available in the 15-inch size class allows for additional configuration elements to be applied to suit the needs of a particular application. For example, when extreme sensitivity is desirable, the two drivers may optionally be wired in parallel, and when extremes of power are required, the drivers may be wired in series. Variances in optimal throat size for highest efficiencies or providing upper band-pass limiting within the maximum available area may also be easily accommodated by the use of the removable driver mounting board 9 employing the desired cavity opening area.

Figure 7:
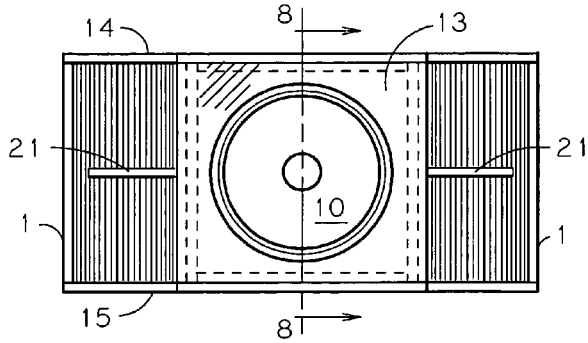
FIG. 7 is a front elevation view the half-height alternative rear-loaded embodiment.
Figure 10:
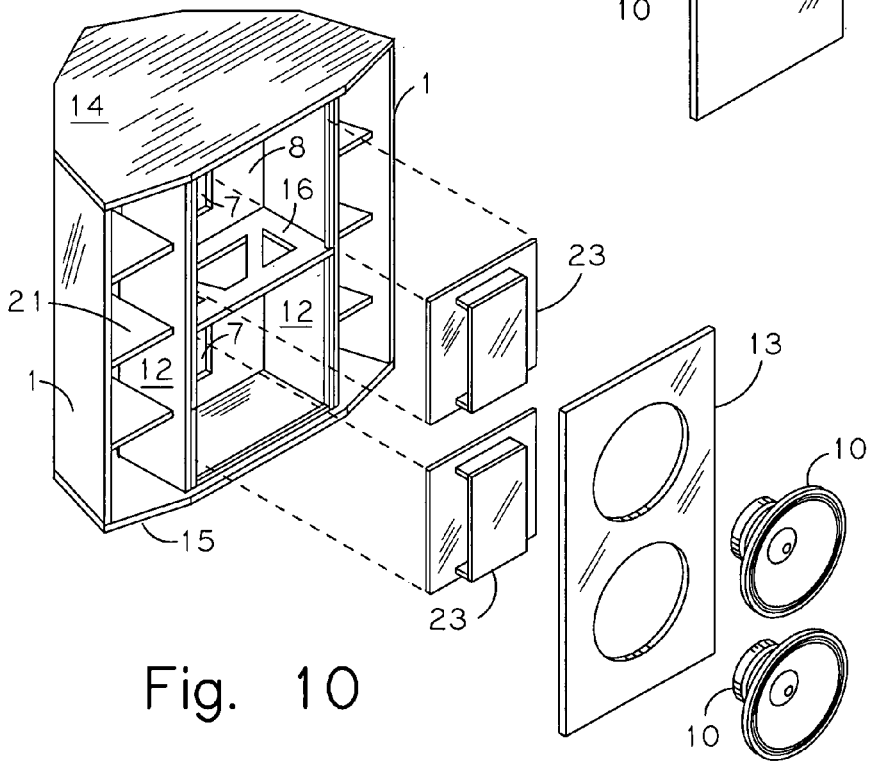
FIG. 10 is an exploded view of the preferred embodiment in a rear-loaded configuration.

Referring to FIG. 10, the preferred embodiment is shown in an alternative rear-loaded configuration. Since the passage of upper-bass frequencies is not generally desirable in rear-loaded horn applications, the use of a front-cavity filter 23 is used to add a capacitive and controllable limit to the upper frequency range from passing through the horn. A possible front-cavity filter and mounting board assembly 23 is shown perspective form in FIG. 10 and in cross-section in FIG. 8. A cavity filter could also consist of simply stapling a piece of sound absorbing material to a driver mounting board 9 over the cavity-opening and mounting it to-the baffle board 8. The half-height version of the rear-loaded alternative embodiment is shown in FIGS. 7 and 8.

The terminal throat channel splitting wedges 4, as seen in FIGS. 1 and 3, bifurcate the propagated waveform traveling rearward from the throat channels into equal vertical halves, and turn each half of the propagated waveform 90 degrees from the center in opposite directions. The splitting wedges 4 are hard-surface waveform reflectors arranged with a 45 degree front-facing surface angle. The terminal throat channel splitting wedges 4 are present in all of the embodiments shown in the drawings.

The rear-most outer side channel walls 3 behind the terminal splitting wedges 4 are arranged specifically at angles so that the sound waves reflect off of them in a consistent and appropriate direction selected to approximate the best-case path to continue propagating down the remaining exit channels. The angles were derived from using mirror reflectors and a light source and therefore presume straight-line "ray" propagation. This technique presumably provides less inter-channel reflections from the channel sidewalls and the associated turbulence normally encountered in folded horns. This positive effect is compounded by the nature of the hard-surface reflections and allows for a wide operating frequency bandwidth as well as preserving a significant degree of wave phase relationships. Additionally, the forward-canted exit splay angles present a better propagation path for shorter wavelengths, and combined with the short overall horn path length, and relatively large throat area, the ability to pass upper-bass frequencies is increased, the remaining limitation being dictated primarily by the mass roll off of the respective drivers employed. The natural wide band pass capability of the current invention is rendered somewhat moot when used in a rear-loaded configuration, of course, where upper band-pass capability is intentionally suppressed to prevent comb filtering effects. The horn pathway can be seen in FIG. 1 as described by dotted line 28.

Referring to FIGS. 1 through 4, the current invention consists of three separate assemblies, one being the exterior channel wall assembly, consisting of mirrored parts 1, 2, 3 including the splitting wedges 4, and second assembly being the interior parts which make up the back chamber and throat channel assembly. The back chamber consists of parts 8, 12, 13 and the top 14 and bottom 15 panels. The third assembly is connective in function and consists primarily of the horizontally disposed components of the enclosure. The connective assembly is composed of the top 14 and bottom 15 panels, along with the horizontal braces 19, 20, 21, best seen in FIG. 4, which combine the other two assemblies together into a cohesive operational unit. Additional braces 16, 22 are used to add structural support, provide attachment points, and reduce panel vibration.

Referring to FIG. 3, the throat channels are comprised of the vertical throat sidewalls 5, the vertical baffles 6 and the central horizontal brace 19. In the preferred embodiment, the rectangular throat cavity opening 7 is horizontally centered and is arranged with the long sides arranged vertically in the baffle board 8. In the alternative embodiment drawings seen in FIGS. 11 through 14, the baffle board 8 is not present.

The exterior channel walls 1, 2, 3 are arranged by function in a substantially parabolic arrangement and form the outside walls of the horn terminal (or exit) channels. The general pattern formed by the exterior channel walls is an approximate parabolic curve when viewed from the top which is a characteristic feature of the present invention. The throat channels exhaust into the focus of the modified parabola formed by the exterior channel walls. The exterior channel wall can be considered as being arranged in a mirrored fashion at the center axis of the parabola.

The interior walls of the terminal exit channels are formed by the outside vertical walls of the back chamber 12 and throat assembly external side walls 11. The distance of separation between the internally exposed rear-most channel walls 3 and the throat side channels 5 is ½ the horizontal width of the throat channel, in the case of the disclosed invention. This separation forms the bifurcated throat sections of the corresponding terminal channels in which the width on axis is also not less than ½ the width of the throat channel.

The intermediate terminal channel outer wall 2, being shown in the drawings as a planar element, is angled at 45 degrees to correspond to the right angle of a corner. The inner portion of the intermediate channel is formed by the throat assembly side walls 11. The space of separation between the inner and outer intermediate channel walls is determined by the exponential expansion rate of 38 Hz.

The terminal exit is formed by the exterior side channel walls 1, which is canted slightly forward from the angle of intermediate channel outer wall 2 to cooperate with the perpendicular back chamber side walls 12 forming the exit channel boundaries. The horn terminus is approximately 800 square inches when the channels are enclosed by the top 14 and bottom 15 panels.

The combination of the rectangular-shaped vertical throat channel exhausting horizontally rearward along the central axis of the enclosure, perpendicular to the splitting wedges 4, the interior channel sides 5 along the throat section, and the angles rear-most side wall reflecting panels 3, the 45 degree channel walls 2, and the forward-splay angles of the terminal exit panels 1 give the invention a characteristic operational feature and also give the invention a unique appearance when viewed from the top or back.

The preferred embodiment back chamber is defined in the rear by the apertured baffle board 8, and in the front by the front panel 13. The back chamber sides 12 are axially arranged front-to-back and provide an attachment surface for the front panel 13, in combination with glue blocks or mounting strips 22 as seen in the drawings for the same purpose, as well as structural support. In the alternative embodiments using an opposed-throat configuration, the baffle board 8 as seen in the preferred embodiments is not present. The opposed-throat configurations instead use horizontally extended throat channel side panels 5 with the appropriate throat cavity openings 7 in opposition. The preferred embodiment back chamber is described in this disclosure as being substantially rectangular in shape due to the generally parallel side walls 12, however, it should be noted that the back chamber could be modified to a different shape such as a trapezoid shape, depending on the particular application.

The front panel 13 is removable in all embodiments, and provides access to the interior of the back chamber. As an added utility, the removable front panel 13 allows for the ability to replace it with an appropriately apertured baffle, permitting the front mounting of drivers for rear-loaded operation. Since the front panel 13 is interchangeable, additions or modifications can be made to it to enlarge the back chamber volume by the addition of a frame or extension as desired, or provisions can be made on the front panel 13 to reduce the available volume if so desired.

In the case of the preferred front-loaded embodiments, the front panel 13 could also be modified to include an external heat-sink element for high output purposes, as it is disposed in close proximity to the magnet structure of each driver.

In the preferred embodiment, as seen in FIGS. 2-4, 9 and 10, the front horizontal back chamber brace 16 is used to suppress vibration of the front panel 13, and is shown with multiple apertures primarily to reduce weight and consequently allow acoustic coupling. The front horizontal brace 16 is not present in the half-height embodiments or in the alternative embodiments.

Figure 4:
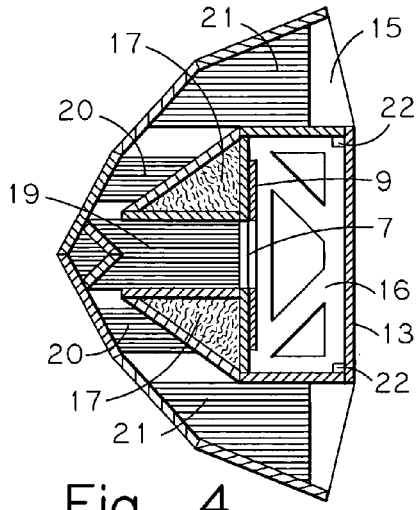
FIG. 4 is a sectional view from line 4-4 of FIG. 3 of the preferred front-loaded embodiment showing the horizontal bracing elements.

Referring to FIG. 4, the horizontal channel braces 19, 20, 21 are shown. Where three tiers of horizontal bracing is described in the drawings of the preferred embodiments as providing the maximum structural support without sonic degradation, it is conceivable that the braces 19, 20, 21 may be reduced to two tiers or less, and otherwise be arranged in a vertically staggered manner to reduce weight. The functional requirement of the horizontal braces 19, 20, 21 is to provide a degree of lateral support for the channel walls and to suppress panel vibration. The function of the horizontal back chamber brace 16 is to suppress vibration of the back chamber walls, baffle board 8, and front panel 13.

Figure 11:
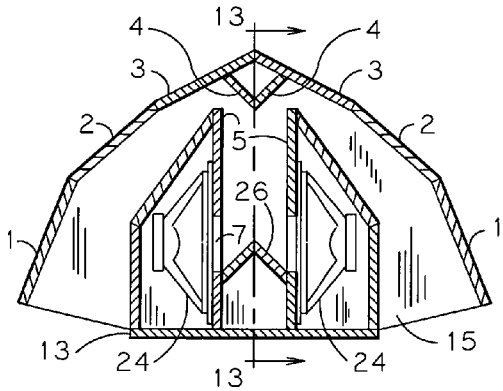
FIG. 11 is a sectional view from line 11-11 of FIG. 12 of an alternative front-loaded embodiment using multiple 12-inch drivers in an opposed-mount throat configuration. This view does not show the horizontal bracing elements.
Figure 12:
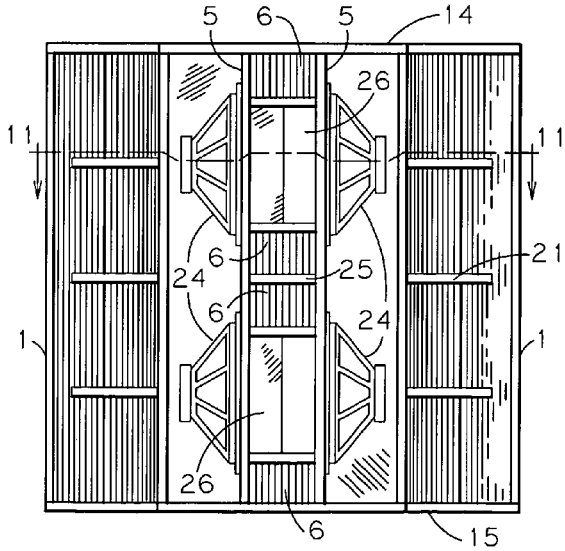
FIG. 12 is a front elevation view of the rear-loaded alternative embodiment as seen in FIG. 11 with the front panel not shown.
Figure 13:
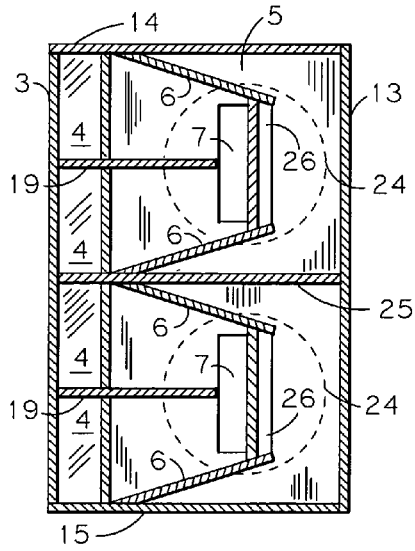
FIG. 13 is a sectional view from line 13-13 of FIG. 11 of the rear-loaded alternative embodiment.

Referring to FIGS. 11, 12 and 13, an alternative embodiment is shown consisting of an opposed-throat configuration using four 12-inch drivers 24. In the alternative embodiments shown in FIGS. 11 through 14, the external channel wall group remains consistent with the preferred embodiments and only the back chamber and throat assembly is adapted for the alternative configuration, and the horizontal brace elements 19, 20, 21 are not shown. It is contemplated that certain modifications could be made to further enhance the utility of the alternative embodiments. An illustrated modification shown in the drawings is that the front panel 13 has been effectively extended forward by oversetting the top and bottom panels, compared to the preferred embodiments. The opposed throat configuration provides-the-ability-to incorporate a heat-sink assembly on the outside of the back chamber through the interior horn channels. In the alternative embodiments as seen in FIGS. 11 through 14, the back chamber is comprised of the total volume of space that is shown as partitioned void spaces 17, 18 in the preferred embodiments. FIG. 12 shows the alternative embodiment with the front panel 13 not shown.

Figure 14:
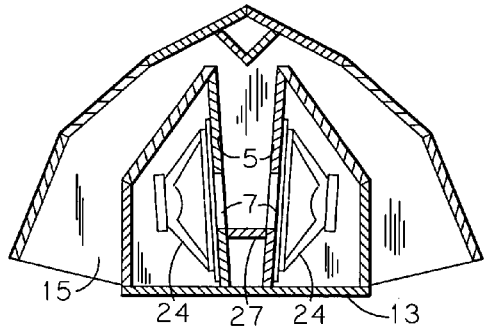
FIG. 14 is a sectional view of another alternative front-loaded embodiment featuring multiple 12-inch drivers in a "clam-shell" type of opposed-mount throat configuration. This view does not show the horizontal bracing elements and is consistent with the view of FIG. 11.

FIG. 14 shows a cross-sectional view of yet another alternative throat arrangement commonly called a "clam-shell" throat configuration, again using four 12-inch drivers 24. The view in FIG. 14 is consistent with the view in FIG. 11, however, it assumes a modified back chamber and throat configuration which is not shown in the other drawings. The alternative 12-inch driver opposed-throat embodiments generally present a simplified form, lacking the necessity of a baffle board 8, as the function is combined in extended throat sidewalls 5. In the case of the alternative 12-inch driver embodiments, certain parts are added, although not necessarily required, for functionality. Specifically, in FIGS. 11 though 13, the addition of cavity opening splitting wedges 26 and an extended central horizontal brace 25 are disclosed. As shown in FIG. 14, the clamshell-throat embodiment includes a throat terminating planar element 27 which would replace the cavity opening splitting wedges 26 seen in FIGS. 11 through 13. The alternative opposed-throat embodiments allow for a great deal of flexibility as to viable throat configurations without departing from the inventive concepts presented herein.

The alternative embodiments could include the use of six 10-inch drivers in an opposed throat configuration, employing three drivers per side, instead of the four 12-inch drivers. This configuration would seem to be particularly applicable as music instrument speakers. It will be expected that the alternative embodiments may not be as readily adaptable to various driver applications as compared to the preferred embodiments. It should also be anticipated that the alternative embodiments could also include half-height versions of the examples shown in the drawings.

It will be understood by those experienced in the art that the overall Fc of the terminal horn dictates the size of the enclosure; therefore, the cabinets shown may be made larger or smaller than the preferred embodiment depending on the target Fc of the alternative application, and alternative drivers may be substituted to suit a particular need.

It should also be realized that the alternative-use configurations, especially in the rear-loaded direct radiator embodiments, the front panel 13 could easily accept multiple drivers or combinations of drivers which are not shown in the drawings. The possible alternative configurations are therefore many and should not be limited to only that which is defined in the drawings.

Whereas this disclosure depicts one specific type of manufacture, it should not be limited to materials and processes that utilize only straight planar elements, such as plywood and the like. It should also be noted that while straight lines have been used for describing the various horn channels and reflectors, an alternative and perhaps better embodiment could utilize curved or concave elements which would promote an even rotational angle or approximate a true exponential curve more closely.

While in accordance with the provisions of the Patent Statutes, the preferred forms and embodiments have been illustrated and described, it will become apparent to those skilled in the art that various changes and modifications may be made without deviating from the inventive concepts set forth above.

I claim:

1. In a horn loudspeaker for the low frequency range; an enclosure comprising:

a plurality of vertical baffles arranged in sealed relation to form a substantially parabolic wall, arranged with the center thereof being most rearward, and the ends thereof being most forward, defining the outside boundary of an expanding column of air, a second plurality of baffles, spaced forward from said rearward wall, at least one of said baffles being adapted with at least one aperture, and including vertical baffles arranged to parallel the axis at the focus of said parabolic wall, defining a primary section of expanding air column which expands predominately vertically from said each aperture and exits rearward along the central horizontal axis of said rearward wall, and further including baffles which define the inner boundaries of said expanding column, at least one sound source, means for turning said primary air column at the junction of said exit and said rearward wall into said expanding column boundaries, and means for completing an air chamber for said sound source and thereby completing said expanding column.

2. In a horn loudspeaker as set forth in claim 1, wherein said sound source consists of at least one electro-acoustic transducer adapted to cooperate in sealed relation with said each aperture.

3. In a horn loudspeaker as set forth in claim 1, wherein said plurality of baffles includes two vertical side baffles arranged with corresponding angles and spaced from said rearward wall as determined by an exponential flare rate, partially completing said expanding column.

4. In a horn loudspeaker as set forth in claim 1, wherein said completing means includes a top, bottom, front, and side baffles in sealed relation with said second plurality of baffles, said apertured baffle, and said rearward wall.

5. In a horn loudspeaker as set forth in claim 4, wherein said front baffle is adapted with at least one aperture, each said front panel aperture being sealed in operating relation by an electro-acoustic transducer.

6. In a horn loudspeaker as set forth in claim 1, wherein said turning means consists of splitting wedges, each having hard surfaces angled to reflect sound waves from said primary column sideways in opposite directions, engaged with said rearward wall and arranged to divide said primary column equally, turning said sound waves horizontally into said expanding column boundaries.

7. In a horn loudspeaker as set forth in claim 6, wherein said turning means further includes the angle at which said first plurality of baffles presents in proximate relation with said splitting wedges, providing a second reflection, whereby the angle of said second reflection presents the best axial path of said sound waves through said expanding column boundaries.

8. A horn loudspeaker for the reproduction of low frequency sound waves comprising:

a bottom and top panel of substantially triangular cross-section, being adapted along the rearward edges opposite of a base forming a substantially parabolic contour, a center axis thereof being the widest point front to back, a plurality of panels vertically arranged side to side, engaged with said parabolic contour on said top and bottom panels, forming a concave-shaped rearward wall, said wall having center portions proximate to said center axis adapted and arranged to reflect sound waves traveling perpendicular to said center axis substantially along said rearward wall in opposite directions from said center axis, two vertical panels, arranged parallel to said center axis and equally spaced from the forward-most outer sides of said rearward wall and forward of said rear wall, aligned with the forward edge of said top and bottom and engaged therewith, therein partially defining the horn terminus, and sized to house at least one sound source.

a further assembly of panels, arranged rearward of said vertical housing panels and forward of said rearward wall, arranged perpendicular to said rearward wall along the center axis of said top and bottom panels, defining a vertically expanding throat channel for said sound source, and exhausting along the center axis of said concave-shaped wall, means for completing expanding terminal channels cooperating with said rearward wall, reflecting means positioned at the rear of said center axis of said concave-shaped wall to equally bifurcate said throat channel horizontally, at outward right angles from said center axis, a removable front panel, vertically arranged, engaged with said housing assembly panels and front edges of said top and bottom panel, and means for transmitting sound into said throat channel.

9. A horn loudspeaker as set forth in claim 8, wherein said completing means includes a plurality of panels arranged vertically in sealed engagement with said further assembly and said housing assembly, cooperating with said rearward wall and spaced therefrom, defining the frontward portion of a substantially exponential horizontally flaring channel, completing an air chamber for said sound source, and thereby completing said terminal channels.

10. A horn loudspeaker as set forth in claim 9, wherein said sound source consists of at least one sound transducer.

11. A horn loudspeaker as set forth in claim 10, wherein said transmitting means includes at least one vertically arranged panel engaged with said throat channel, having at least one aperture therein, adapted to cooperate in sealed engagement with said sound transducer, thereby transmitting sound from said sound transducer to said throat channel therebeyond.

12. A horn loudspeaker as set forth in claim 10, wherein said transmitting means includes at least one vertically arranged panel engaged with said throat channel, having at least one aperture therein, thereby transmitting sound from said sound source to said throat channel therebeyond.

13. A horn loudspeaker as set forth in claim 12, wherein said transmitting means further includes said front panel, apertured and adapted to cooperate in sealed engagement with said sound transducer, thereby transmitting sound from the rear of said sound source to said apertured panel, through said air chamber, and through said each aperture to said throat channel therebeyond.

* * * * *